US009180418B2

(12) United States Patent
Cho et al.

(10) Patent No.: US 9,180,418 B2
(45) Date of Patent: Nov. 10, 2015

(54) METHOD OF MIXING AT LEAST TWO KINDS OF FLUIDS IN CENTRIFUGAL MICRO-FLUID TREATING SUBSTRATE

(75) Inventors: Yoon-kyoung Cho, Yongin-si (KR); Jeong-gun Lee, Yongin-si (KR); Beom-seok Lee, Yongin-si (KR); Jong-myeon Park, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1809 days.

(21) Appl. No.: 11/751,677

(22) Filed: May 22, 2007

(65) Prior Publication Data

US 2008/0056063 A1 Mar. 6, 2008

(30) Foreign Application Priority Data

Aug. 31, 2006 (KR) ..... 10-2006-0083656
Jan. 24, 2007 (KR) ..... 10-2007-0007645

(51) Int. Cl.
*B01F 11/00* (2006.01)
*B01F 13/00* (2006.01)
*B01F 15/02* (2006.01)

(52) U.S. Cl.
CPC ..... *B01F 13/0059* (2013.01); *B01F 11/0002* (2013.01); *B01F 11/0014* (2013.01); *B01F 15/0233* (2013.01); *B01F 15/0201* (2013.01)

(58) Field of Classification Search
CPC ..... B01F 11/0002; B01F 11/0014; B01F 13/0059; B01F 15/0233; B01F 15/0201
USPC ..... 366/92–93, 130, 237, 341, 366/DIG. 1–DIG. 4
See application file for complete search history.

(56) References Cited

U.S. PATENT DOCUMENTS

| | | | | |
|---|---|---|---|---|
| 3,397,867 | A * | 8/1968 | Hoff | 366/341 |
| 6,170,981 | B1 * | 1/2001 | Regnier et al. | 366/336 |
| 6,482,306 | B1 * | 11/2002 | Yager et al. | 204/600 |
| 6,550,955 | B2 * | 4/2003 | D'Silva | 366/130 |
| 6,655,829 | B1 * | 12/2003 | Vanden Bussche et al. | 366/165.1 |
| 6,916,113 | B2 * | 7/2005 | Van de Goor et al. | 366/108 |
| 6,919,058 | B2 | 7/2005 | Andersson et al. | |
| 6,935,768 | B2 * | 8/2005 | Lowe et al. | 366/167.1 |
| 7,097,347 | B2 * | 8/2006 | Vanden Bussche et al. | 366/165.1 |
| 8,602,636 | B2 * | 12/2013 | Kauling et al. | |
| 2003/0003464 | A1 * | 1/2003 | Phan et al. | 435/6 |

(Continued)

FOREIGN PATENT DOCUMENTS

| | | | |
|---|---|---|---|
| EP | 1894617 | A2 * | 3/2008 |
| JP | 2007-40833 | A | 2/2007 |

(Continued)

OTHER PUBLICATIONS

Grumann et al., "Batch-mode mixing on centrifugal microfluidic platforms", Lab Chip, 2005, pp. 560-565, vol. 5, The Royal Society of Chemistry English.

*Primary Examiner* — Charles Cooley
(74) *Attorney, Agent, or Firm* — Sughrue Mion, PLLC

(57) ABSTRACT

Provided is a method of mixing fluids including introducing at least two kinds of fluids to a chamber of a substrate including a microchannel structure; and alternately rotating the substrate clockwise and counter-clockwise until the at least two kinds of fluids are mixed, wherein the rotation is changed from one direction to the opposite direction before a vortex created in the mixing chamber by the one direction rotation disappears.

15 Claims, 8 Drawing Sheets

(56) References Cited

U.S. PATENT DOCUMENTS

| | | | | |
|---|---|---|---|---|
| 2003/0044322 | A1* | 3/2003 | Andersson et al. | 422/100 |
| 2004/0027915 | A1* | 2/2004 | Lowe et al. | 366/341 |
| 2005/0221281 | A1 | 10/2005 | Ho | |
| 2009/0180933 | A1* | 7/2009 | Kauling et al. | |
| 2012/0300576 | A1* | 11/2012 | Li et al. | 366/338 |
| 2015/0138912 | A1* | 5/2015 | Clime et al. | 366/165.2 |

FOREIGN PATENT DOCUMENTS

| | | | |
|---|---|---|---|
| WO | 02/051537 | A2 | 7/2002 |
| WO | 03/054509 | A2 | 7/2003 |

* cited by examiner

2mm_0.15 sec

2mm_0.23 sec

2mm_0.30 sec

METHOD OF MIXING AT LEAST TWO KINDS OF FLUIDS IN CENTRIFUGAL MICRO-FLUID TREATING SUBSTRATE

CROSS-REFERENCE TO RELATED PATENT APPLICATION

This application claims the benefit of Korean Patent Application No. 10-2006-0083656, filed on Aug. 31, 2006, and Korean Patent Application No. 10-2007-0007645, filed on Jan. 24, 2007, in the Korean Intellectual Property Office, the disclosure of which is incorporated herein in its entirety by reference.

BACKGROUND OF THE INVENTION

1. Field of the Invention

The present invention relates to a method for rapidly mixing at least two kinds of fluids in a micro-fluidic device which uses centrifugal force.

2. Description of the Related Art

In a micro-fluidic device such as a lab-on-a-chip in which microliter or nanoliter of fluids are treated, different shapes of chambers for performing various reactions and channels through which fluids flow are arranged. In the micro-fluidic device, a fluid usually has a low Reynolds number. At a low Reynolds number, laminar flow occurs, and thus a process of introducing at least two kinds of fluids into the micro-fluidic device and mixing them cannot rapidly be performed. This is true for micro-fluidic devices using centrifugal force (e.g., devices having a CD-shaped substrate) to drive fluid flow within the device.

U.S. Pat. No. 6,919,058 discloses a CD-shaped micro-fluid treatment substrate for rapidly mixing fluids including a micro-cavity in which two fluids meet, and a mixing channel which curvedly extends from the micro-cavity. However, there is difficulty to integrate the micro-fluid treatment substrate into micro-fluidic devices since the mixing channel occupies too large volume of space. Also, as the number of fluids to be mixed increases, the size of the micro-fluid treatment substrate needs to be increased.

Meanwhile, a method of rapidly mixing fluids including introducing a plurality of magnetic beads into fluids and inducing the magnetic beads movement using magnetic force while rotating the micro-fluid treatment substrate is disclosed in Grumann et al., Batch-mode Mixing On Centrifugal Microfluidic Platforms, Lab chip, vol. 5, pp. 560~565, 2005. However, this method requires an introduction of magnetic beads into the device and an appropriate arrangement of magnets to move or vortex the magnetic beads.

SUMMARY OF THE INVENTION

The present invention provides a method of rapidly mixing at least two kinds of fluids in a micro-fluidic device using an appropriate rotating program.

According to one aspect of the present invention, there is provided a method of mixing fluids including introducing at least two kinds of fluids to a chamber in a substrate, the substrate comprising a microchannel structure; and providing an alternating rotation of the substrate in clockwise and counter-clockwise directions until the at least two kinds of fluids are mixed in the chamber, wherein the alternating rotation is performed by changing a direction of the rotation from one direction to the other direction before a vortex created in the chamber by the rotation of the one direction disappears.

In one exemplary embodiment, the at least two kinds of fluids are introduced sequentially into the chamber and the alternating rotation of the substrate is carried out after all of the fluids are introduced into the chamber.

In another exemplary embodiment, at least one of the at least two kinds of fluids is introduced into the chamber while the alternating rotation of the substrate is performed.

According to another aspect of the present invention, there is provided a method of mixing fluids including introducing a first fluid to a first chamber of a substrate, the substrate having a microchannel structure; introducing a second fluid to a second chamber which is in fluid communication with the first chamber; and providing an alternating rotation of the substrate to allow the second fluid in the second chamber to flow into the first chamber and is mixed with the first fluid in the first chamber, wherein the alternating rotation of the substrate is performed by changing a direction of the rotation from one direction to the other direction before a vortex created in the chamber by the rotation of the one direction disappears.

A rotation frequency distribution of a clockwise rotation and a rotation frequency distribution of a counter-clockwise rotation may be symmetrical or asymmetrical.

A maximum rotation frequency during the clockwise and counter-clockwise rotations may be in the range of 5 to 60 Hz.

The rotation frequency of the clockwise and counter-clockwise rotations may be constant or gradient. An initial rotation frequency may be in the range of 0 Hz to the maximum rotation frequency as stated above for each of the clockwise and counter-clockwise rotations.

The clockwise and counter-clockwise rotations each may include an acceleration stage.

A rotation frequency rate is in the range of 20 to 150 Hz/s in the acceleration stage.

At least one of the fluids may include a plurality of particles having an average diameter up to 10 μm.

The time period for the clockwise and counter-clockwise rotations may be symmetrical or asymmetrical. Duration of each of the clockwise and counter-clockwise rotations may be less than 10 seconds.

The duration of each of the clockwise and counter-clockwise rotations may be less than 1 second.

The mixing chamber may include a protrusion on its inner surfaces to facilitate a vortex creation in the mixing chamber.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
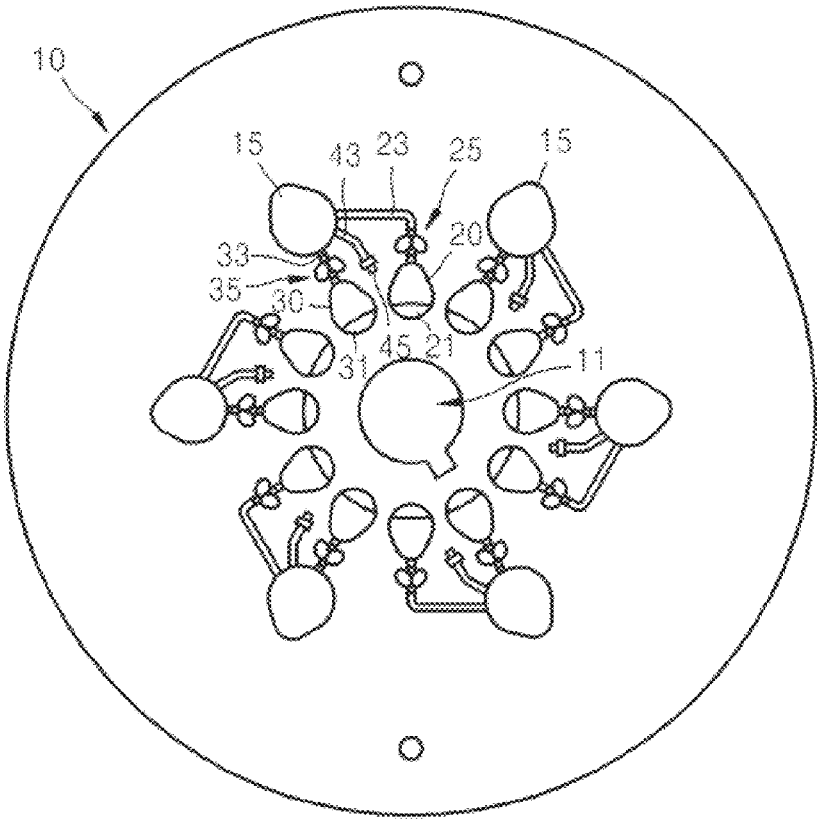
FIG. 1 is a plane view of a rotable substrate of a micro-fluidic device, which is suitable for use in a method of mixing fluids according to an embodiment of the present invention.

FIG. 1 is a plane view of a rotable substrate of a microfluidic device, which is suitable for use in a method of mixing fluids according to an embodiment of the present invention.

According to FIG. 1, the substrate 10 that is used in a method of mixing fluids according to an embodiment of the present invention is CD-shaped and is rotated clockwise or counter-clockwise by an action of a motor. The motor may be a spindle motor which is fixed in the center of the substrate by hole 11. The substrate 10 has a plurality of microchannel structures including chambers, channels (passages), valves and other microstructures adapted for a microfluidic device. A centrifugal force generated by the rotation of the substrate moves fluids from an inner position to an outer position in relation to a spinning axis, such as an axis of symmetry of the substrate 10. The direction and speed of rotation of the substrate 10 may vary according to a rotating program of the spindle motor.

In an exemplary embodiment, the substrate includes a first supply chamber 20 to receive a first fluid, a second supply chamber 30 to receive a second fluid, and a mixing chamber 15. The mixing chamber is a chamber where two fluids are mixed and subsequent biochemical or chemical reactions or analysis may occur. The first and second fluids differ from each other and are mixed in the mixing chamber 15. The mixing chamber 15 is disposed farther than the first and second supply chambers 20 and 30 from a spinning axis, i.e., the center or the symmetry axis of the substrate 10 such that the centrifugal force generated by the rotation of the micro-fluid treatment substrate 10 moves the fluids from the first and second supply chambers 20 and 30 to the mixing chamber 15. FIG. 1 illustrates a substrate having six sets of the first and second supply chambers 20 and 30 and the mixing chamber 15, but it should be understood that a substrate which is suitable for use in the present invention may have a smaller or larger number of sets of supply and mixing chambers.

In addition, a first inlet port 21 introducing the first fluid to the first supply chamber 20 and a second inlet port 31 introducing the second fluid to the second supply chamber 30 are disposed on substrate 10. A first channel 23 connecting the first supply chamber 20 with the mixing chamber 15 and a second channel 33 connecting the second supply chamber 30 with the mixing chamber 15 are disposed substrate 10. The first channel 23 and the second channel 33 may be open and closed using a first valve 25 and a second valve 35, respectively. An outlet port 45 for discharging the mixed fluid and an outlet channel 43 connecting the mixing chamber 15 with the outlet port 45 are disposed on the micro-fluid treatment substrate 10. The first supply chamber 20, first channel 23 and the mixing chamber 15 are in fluid communication with each other. Likewise, the second supply chamber 30, the second channel 33 and the mixing chamber 15 are in fluid communication with each other.

Figure 2:
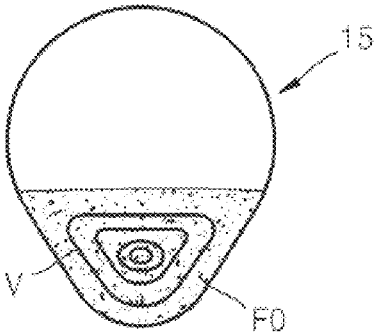
FIG. 2 is a plane view of a mixing chamber in which a vortex is created in a fluid by rotating the substrate.
Figure 3:
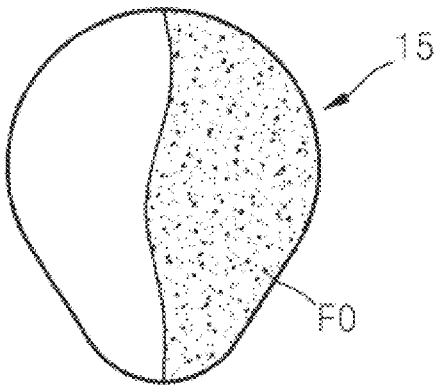
FIG. 3 is a plane view of a mixing chamber in which a flip-over is created in the fluid by changing the rotation direction of the substrate.

FIG. 2 is a plane view of a mixing chamber in which a vortex is created in a fluid by rotating the substrate, and FIG. 3 is a plane view of a mixing chamber in which a flip-over is created in the fluid by changing the rotation direction of the substrate.

On the assumption that the fluids can be rapidly mixed if turbulence is continuously maintained in the mixing chamber 15 of the substrate 10 (FIG. 1), a fluid F0 was allowed to flow into the mixing chamber 15 and the micro-fluid treatment substrate 10 was rotated in one direction, for example clockwise, starting with a rotation frequency of 0 Hz in a rotation frequency increase rate of 60 Hz/s. As a result, a vortex V was created and maintained as shown in FIG. 2 for up to 0.15 seconds, followed by stabilization. Thus, it was inferred and confirmed by the inventors of the present invention that the turbulence may be maintained when the rotation of the substrate 10 is changed to the opposite direction before the vortex V is stabilized and disappears, i.e., is changed to the opposite direction while the vortex V exists. In addition, when the rotation of the substrate 10 is changed to the opposite direction, a flip-over of the fluid F0 is created in the mixing chamber 15 as illustrated in FIG. 3, which may further improve a rapid mixing of the fluids.

To confirm the effectiveness of the method of mixing fluids, two different colored fluids were introduced to the mixing chamber 15, and the substrate 10 was alternately rotated in opposite directions, resulting in a mixing of the fluids. FIGS. 4A through 4D are graphs illustrating rotation frequency distributions used in one exemplary embodiment of the present invention.

Hereinafter, the process of the experiment will be described in detail with reference to FIG. 1.

First, a first fluid was introduced to the first supply chamber 20 through the first inlet port 21, and a second fluid was introduced to the second chamber 30 through the second inlet port 31. A plurality of bead particles was included in the second fluid to facilitate mixing of the first fluid and the second fluid. In the experiment, bead particles having an average diameter of about 1 μm were used, but any particles having a diameter greater than 1 μm can be used as long as it does not interrupt the flow of the second fluid through the second channel 33. The particles may be in different shapes including, but not limited to, spheres, cylinders, pellets or tablets. In one embodiment, bead particles having a diameter between 0 and 10 μm may be used. Next, the first valve 25 blocking the first channel 23 was opened, and the substrate 10 was rotated to introduce the first fluid to the mixing chamber 15 by the centrifugal force. Then, the second valve 35 blocking the second channel 33 was opened, and the substrate 10 was rotated to introduce the second fluid to the mixing chamber 15. The mixing chamber 15 is 3 mm deep and 100 μl of each of the first and second fluids were introduced therein.

Figure 4A:
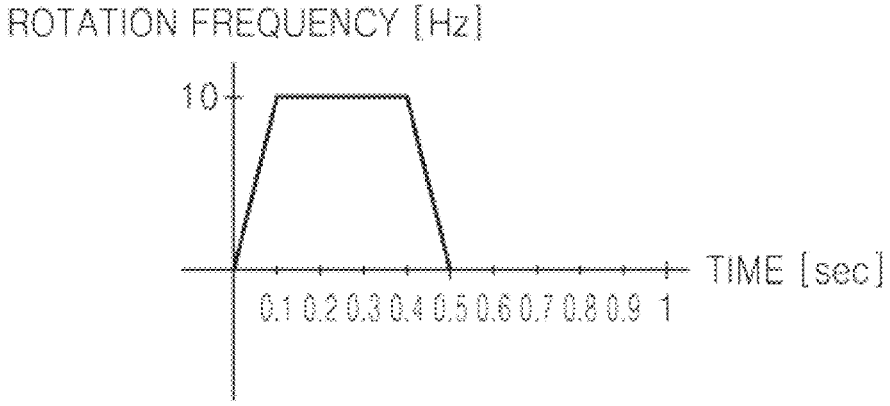
FIGS. 4A through 4D are graphs illustrating rotation frequency distributions used in performing a method of mixing fluids according to an embodiment of the present invention.

Then, as illustrated in FIG. 4A, in an acceleration stage, the substrate 10 was rotated in one direction, for example clockwise, for 0.1 seconds, while accelerating at the rotation frequency rate of 100 Hz/s. The rotation was maintained at constant velocity at the rotation frequency increase of 10 Hz for 0.3 seconds in a constant velocity stage, and then the rotation was decelerated for 0.1 seconds at the rotation frequency increase rate of −100 Hz/s in a deceleration stage.

Thus, the first fluid and the second fluid were completely mixed as a result of the rotation of one direction, for example clockwise rotation, for 0.5 seconds.

Figure 4B:
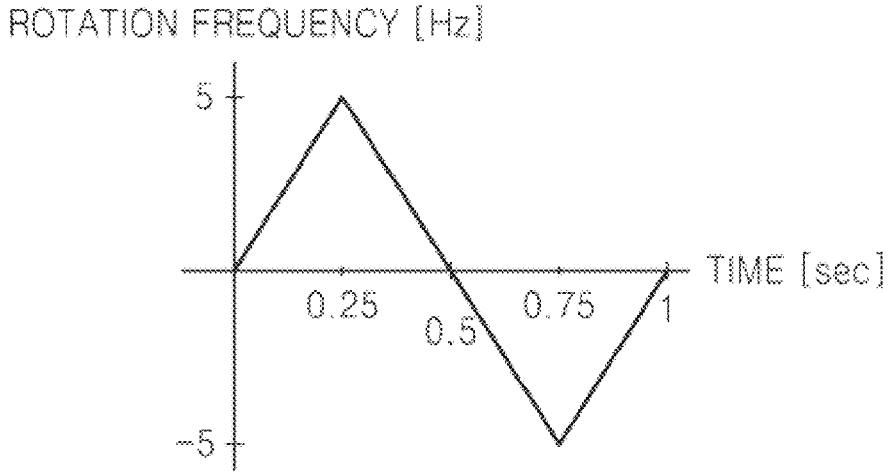

Meanwhile, according to another experimental example as illustrated in FIG. 4B, rotation of the micro-fluid treatment substrate 10 in one direction, for example clockwise, was accelerated for 0.25 seconds at the rotation frequency increase rate of 20 Hz/s in an acceleration stage, and the rotation was decelerated for 0.25 seconds at the rotation frequency increase rate of −20 Hz/s in a deceleration stage, and then the rotation of the substrate 10 in the opposite direction, for example counter-clockwise, was accelerated for 0.25 seconds at the rotation frequency increase rate of 20 Hz/s in an acceleration stage (negative gradient on the graph in FIG. 4B), and the rotation was decelerated for 0.25 seconds at the rotation frequency increase rate of −20 Hz/s in a deceleration stage (positive gradient on the graph in FIG. 4B). Thus, the first fluid and the second fluid were mixed homogenously by changing the rotation direction once in 1.0 seconds.

Figure 4C:
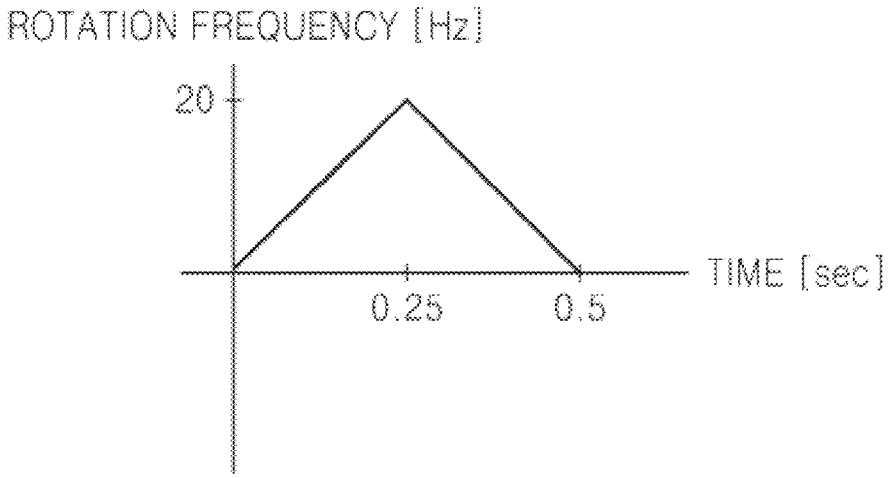

According to another experimental example as illustrated in FIG. 4C, rotation of the substrate 10 in one direction, for example clockwise, was accelerated for 0.25 seconds at the rotation frequency increase rate of 80 Hz/s in an acceleration stage, and the rotation was decelerated for 0.25 seconds at the rotation frequency increase rate of −80 Hz/s in a deceleration stage. Thus, the first fluid and the second fluid were mixed homogenously as a result of the rotation in one direction, for example clockwise, for 0.5 seconds.

Figure 4D:
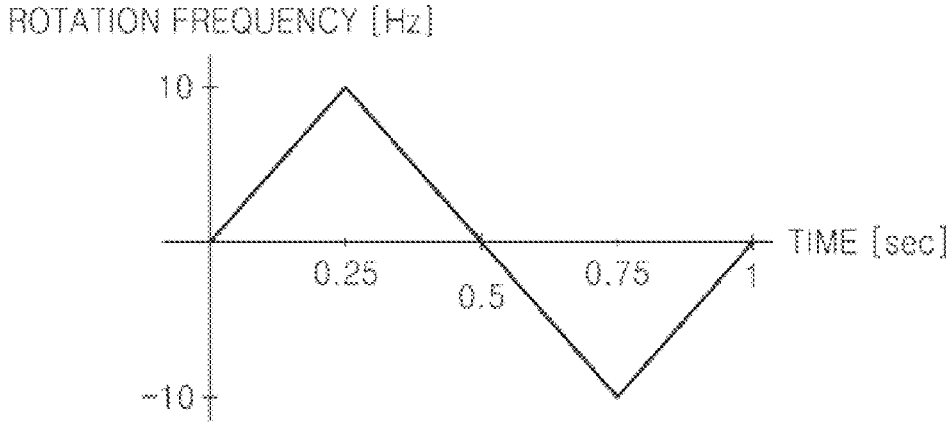

According to another experimental example as illustrated in FIG. 4D, rotation of the substrate 10 in one direction, for example clockwise, was accelerated for 0.25 seconds at the rotation frequency increase rate of 80 Hz/s in an acceleration stage, and the rotation was decelerated for 0.25 seconds at the rotation frequency increase rate of −80 Hz/s in a deceleration stage, and then the rotation of the substrate 10 in the opposite direction, for example counter-clockwise, was accelerated for 0.25 seconds at the rotation frequency increase rate of 40 Hz/s in an acceleration stage (negative gradient on the graph in FIG. 4D), and the rotation was decelerated for 0.25 seconds at the rotation frequency increase rate of −40 Hz/s in a deceleration stage (positive gradient on the graph in FIG. 4D). Thus, the first fluid and the second fluid were mixed homogenously by changing the rotation direction once in 1.0 seconds.

These experiments confirmed that fluids including particles can be mixed homogenously within 1 second, and fluids can be mixed more rapidly with a higher rotation frequency increase rate.

Figure 5A:
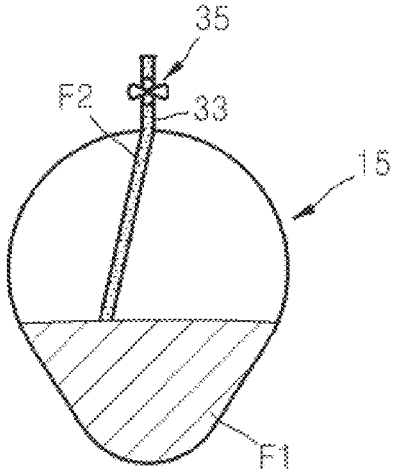
FIGS. 5A and 5B are plane views for explaining a method of mixing fluids according to another embodiment of the present invention.
Figure 5B:
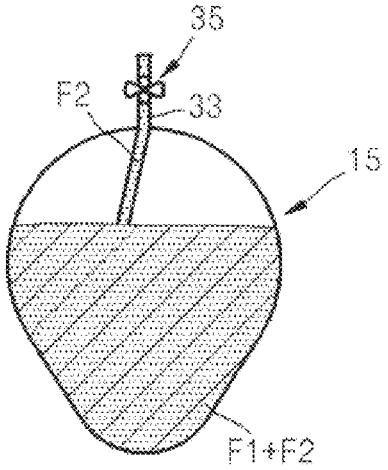

The inventors of the present invention also performed another experiment of simultaneously introducing and mixing at least two kinds of fluids in a mixing chamber. FIGS. 5A and 5B are plane views for explaining the method of mixing fluids while introducing the fluids to the mixing chamber, and FIGS. 6A and 6B are graphs illustrating rotation frequency distributions used in performing the method of mixing fluids while introducing the fluids to the mixing chamber, according to another experiment of the present invention.

Hereinafter, the process of the experiment will be described in detail with reference to FIG. 1.

First, a first fluid was introduced to the first supply chamber 20 through the first inlet port 21, and a second fluid was introduced to the second chamber 30 through the second inlet port 31. Then, the first valve 25 blocking the first channel 23 was opened, and the substrate 10 was rotated to introduce the first fluid to the mixing chamber 15 by centrifugal force. Then, the second valve 35 blocking the second channel 33 was opened, and the micro-fluid treatment substrate 10 was rotated according to a rotation frequency program illustrated in FIG. 6A or 6B to mix the first and second fluids while introducing the second fluid to the mixing chamber 15. As illustrated in FIG. 5A, when the rotation of the substrate 10 was initiated, the second fluid F2 was introduced to the mixing chamber 15 including the first fluid F1 through the open second channel 33. Then, when the substrate 10 was alternately rotated clockwise and counter-clockwise, the second fluid F2 was continuously introduced to the mixing chamber 15 as illustrated in FIG. 5B, and the amount of the mixed fluid of the first fluid F1 and the second fluid F2 increased in the mixing chamber 15.

Figure 6A:
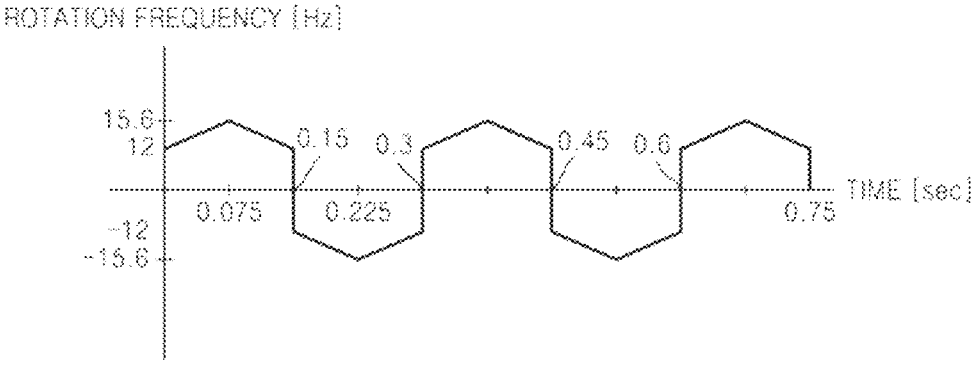
FIGS. 6A and 6B are graphs illustrating rotation frequency distributions used in performing a method of mixing fluids according to another embodiment of the present invention.
Figure 6B:
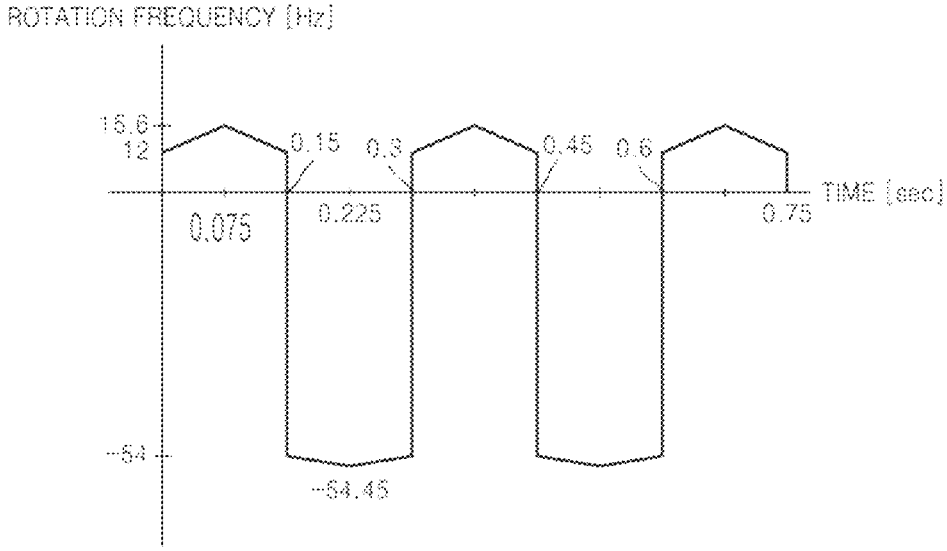

According to a rotation frequency program illustrated in FIG. 6A, rotation of the substrate 10 was initiated in one direction, for example clockwise, at an initial rotation frequency of 12 Hz, the rotation was accelerated for 0.075 seconds at the rotation frequency increase rate of 0.8 Hz/s in an acceleration stage, and the rotation was decelerated for 0.075 seconds at the rotation frequency increase rate of −0.8 Hz/s in a deceleration stage until the rotation frequency reached 12 Hz. Then, rotation of the substrate 10 was initiated in the opposite direction, for example counter-clockwise, at an initial rotation frequency of 12 Hz, was accelerated for 0.75 seconds at the rotation frequency increase rate of 0.8 Hz/s in an acceleration stage (negative value for the initial rotation frequency and negative gradient for the rotation frequency rate on the graph in FIG. 6A since the rotation was performed in the opposite direction), and the rotation was decelerated for 0.075 seconds at the rotation frequency increase rate of −0.8 Hz/s in a deceleration stage until the rotation frequency reached 12 Hz (positive gradient for the rotation frequency rate and negative gradient for the dependent rotation frequency on the graph in FIG. 6A since the rotation was performed in the opposite direction). The rotations of the micro-fluid treatment substrate 10 were repeatedly alternated between one direction (clockwise) and the opposite direction (counter-clockwise) with a symmetric rotation frequency distribution until the first fluid (F1 of FIG. 5A) and the second fluid (F2 of FIG. 5A) were homogenously mixed.

According to a rotation frequency program illustrated in FIG. 6B, rotation of the substrate 10 was initiated in one direction, for example clockwise, at an initial rotation frequency of 12 Hz, the rotation was accelerated for 0.075 seconds at the rotation frequency increase rate of 0.8 Hz/s in an acceleration stage, and the rotation was decelerated for 0.075 seconds at the rotation frequency increase rate of −0.8 Hz/s in a deceleration stage until the rotation frequency reached 12 Hz. Next, rotation of the micro-fluid treatment substrate 10 was initiated in the opposite direction, for example counter-clockwise, at an initial rotation frequency of 54 Hz, the rotation was accelerated for 0.075 seconds at the rotation frequency increase rate of 0.1 Hz/s in an acceleration stage (negative value for the initial rotation frequency and negative gradient for the rotation frequency rate on the graph in FIG. 6B since the rotation was performed in the opposite direction), and the rotation was decelerated for 0.075 seconds at the rotation frequency increase rate of −0.1 Hz/s in a deceleration stage until the rotation frequency reached 54 Hz (positive gradient for the rotation frequency rate and negative gradient for the dependent rotation frequency on the graph in FIG. 6B since the rotation was performed in the opposite direction). The rotations of the substrate 10 were repeatedly alternated between one direction (clockwise) and the opposite direction (counter-clockwise) with an asymmetric rotation frequency distribution until the first fluid (F1 of FIG. 5A) and the second fluid (F2 of FIG. 5A) were homogenously mixed.

Figure 7A:
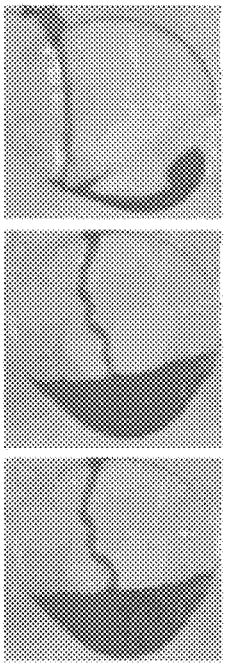
FIGS. 7A to 7D are pictures illustrating a simultaneous introduction and mixing of fluids in a mixing chamber according to another embodiment of the present invention.
Figure 7B:
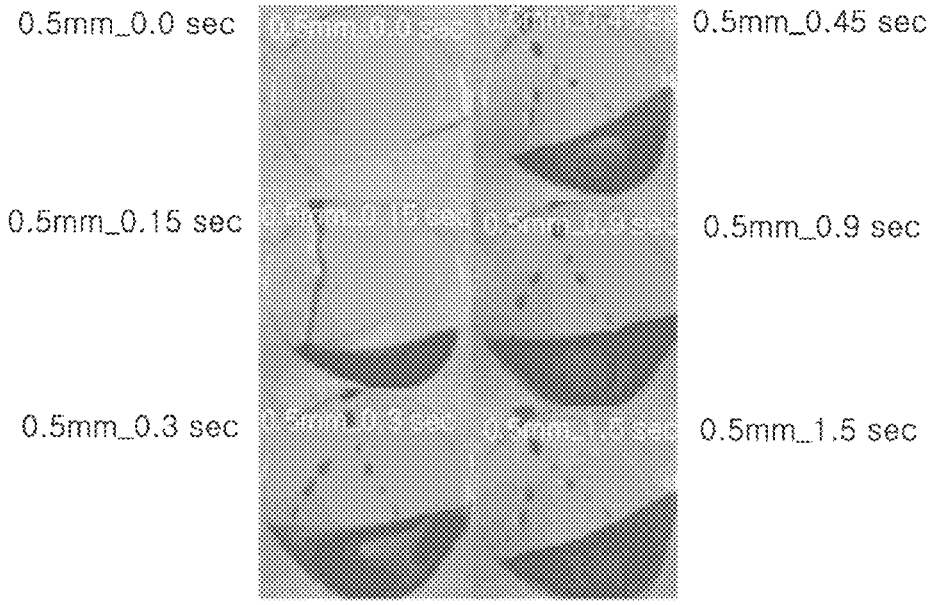
Figure 7C:
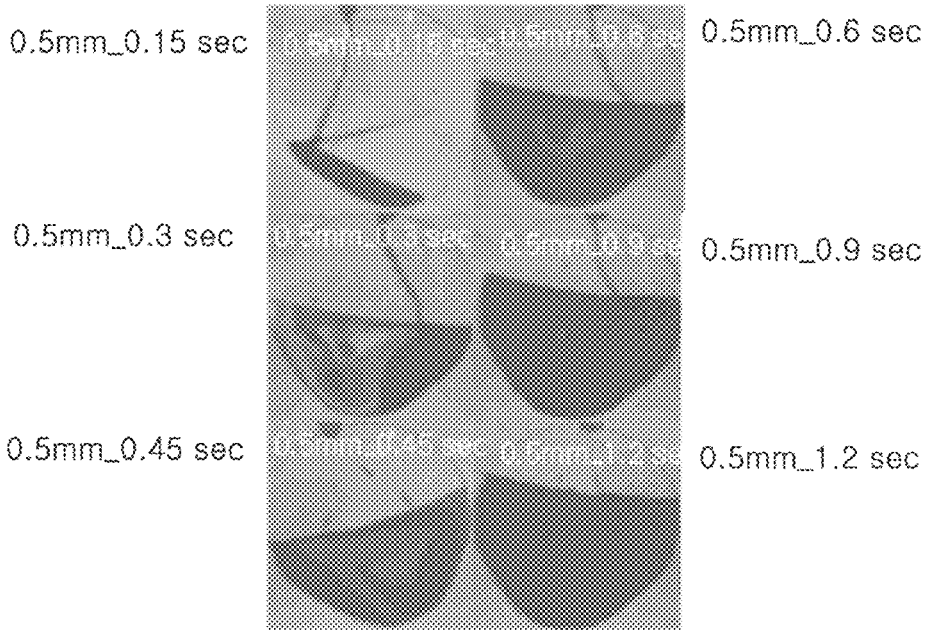
Figure 7D:
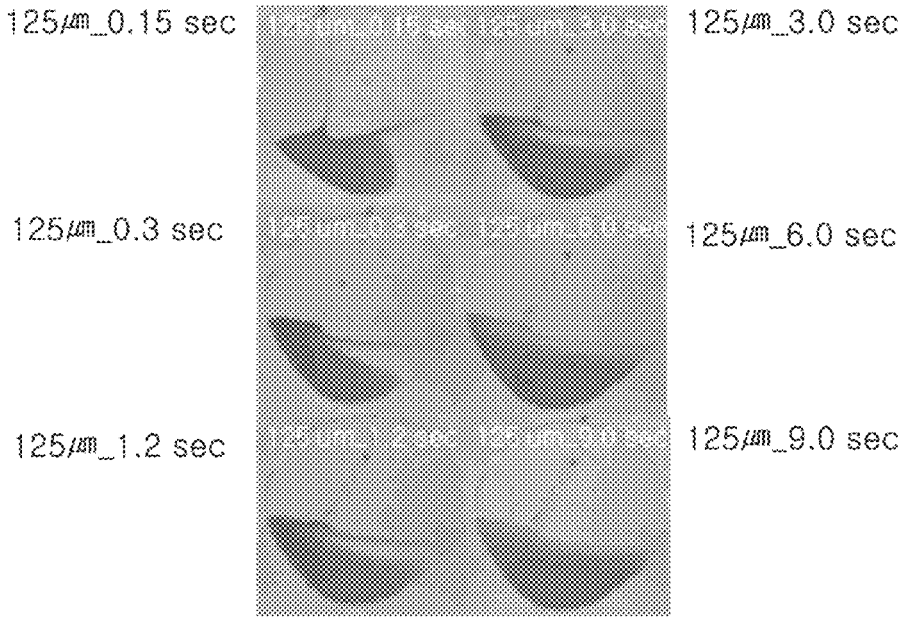

FIGS. 7A and 7D are pictures illustrating a method of mixing fluids while introducing the fluids according to another experiment of the present invention.

In a first experimental example of mixing fluids while introducing fluids to the mixing chamber 15, the mixing chamber 15 was 2 mm deep with a volume of 100 μℓ. The volume of each of the first fluid F1, which was colorless, and the second fluid F2, which was red (shown in dark color in FIG. 7A), was respectively 30 μℓ. The substrate 10 was rotated according to the rotation frequency program (referred to as "a symmetric rotation frequency program") illustrated in FIG. 6A. As a result, it was confirmed that the second fluid F2 was completely transferred to the mixing chamber 15 and the first fluid F1 and the second fluid F2 were homogenously mixed by changing the rotation direction once in 0.3 seconds as illustrated in FIG. 7A.

In a second experimental example of mixing fluids while introducing fluids to the mixing chamber 15, the mixing chamber 15 was 0.5 mm deep with a volume of 25 μℓ. The volume of each of the colorless first fluid F1 and the red second fluid F2 (shown in dark color in FIG. 7B) was respectively 7.5 μℓ. The substrate 10 was rotated according to the rotation frequency program illustrated in FIG. 6A. As a result, it was confirmed that the first fluid F1 and the second fluid F2 were homogenously mixed by changing the rotation direction 9 times in 1.5 seconds as illustrated in FIG. 7B.

In a third experimental example, the mixing chamber 15 was 0.5 mm deep with a volume of 25 μl. The volume of each of the colorless first fluid F1 and the red second fluid F2 (shown in dark color in FIG. 7C) was respectively 7.5 μℓ. The substrate 10 was rotated according to a rotation frequency program (referred to as "an asymmetric rotation frequency program') illustrated in FIG. 6B. As a result, the first fluid F1 and the second fluid F2 were homogenously mixed by changing the rotation direction 7 times in 1.2 seconds as illustrated in FIG. 7C.

In a forth experimental example, the mixing chamber 15 was 0.125 mm deep with a volume of 6.25 μl. The volume of each of the colorless first fluid F1 and the red second fluid F2 (shown in dark color in FIG. 7D) was respectively 1.875 μℓ. The micro-fluid treatment substrate 10 was rotated according to the rotation frequency program illustrated in FIG. 6A. As a result, the first fluid F1 and the second fluid F2 were homogenously mixed by rotating the substrate 10 for longer than 9 seconds as illustrated in FIG. 7D.

Accordingly, with reference to the first, second and forth experimental examples, it can be inferred that the time required to mix the fluids increased as the depth of the mixing chamber 15 become smaller. The depth of the mixing chamber 15 may be in the range of about 0.5 mm to about 3 mm. Referring to the comparison between the second and forth experimental examples, it can also be inferred that the fluids can be mixed more rapidly when a rotation frequency distribution in one direction (e.g., clockwise) and a rotation frequency distribution in the opposite direction (e.g., counter-clockwise) are asymmetrical compared to when the rotation frequency distributions are symmetrical. It also was found that a simultaneous mixing and introduction of fluids into a mixing chamber is more efficient compared to the method of sequential introduction and mixing of fluids.

Figure 8:
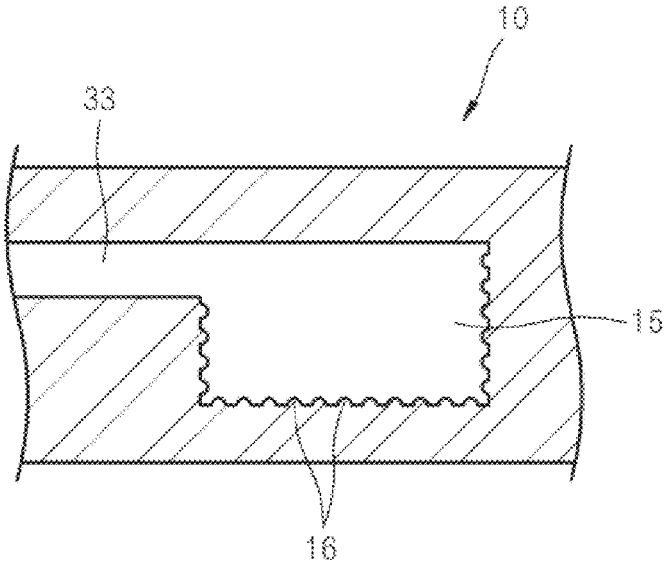
FIG. 8 is a partial cross sectional view of a substrate that is used in a method of mixing fluids according to another embodiment of the present invention.

FIG. 8 is a cross sectional view of a substrate used in a method of mixing fluids according to another embodiment of the present invention. It illustrates a modification made to the substrate illustrated in FIG. 1. Hereinafter, constitutions of FIG. 8 which are different from those of FIG. 1 are described in detail.

Referring to FIG. 8, a protrusion 16 which facilitates vortex creation may be provided on an inside surface of the mixing chamber 15 of the substrate 10. The protrusion 16 may be a plurality of protrusions which may be in a regular shape or irregular shape and are projected from an inside surface of the mixing chamber 15. The protrusion 16 may also be a pattern engraved on the inner surface of the mixing chamber 15. The protrusion 16 promotes vortex creation and enlarges the scale of the vortex, and thus renders a faster mixing of at least two kinds of fluids in the mixing chamber 15.

According to an exemplary embodiment of the present invention, the duration of each rotation of the substrate is less than 1 second. However, the vortex created in the mixing chamber by the rotation in one direction can be maintained for about 10 seconds by adjusting the rotational angular velocity, and thus fluids can be effectively mixed.

According to embodiments of the present invention, various kinds of fluids can be rapidly mixed in a microchannel chamber of a microfluidic device which uses the centrifugal force.

In addition, the substrate can be easily integrated into a microfluidic device since it is not required to enlarge the substrate or to add additional elements such as magnets to the substrate to attain a rapid mixing of the fluids.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, the present invention may be applied to a method of mixing three kinds of fluids or more.

What is claimed is:

1. A method of mixing fluids comprising:

introducing at least two kinds of fluids to a chamber in a substrate, the substrate comprising a microchannel structure; and rotating the substrate in clockwise and counter-clockwise directions according to a predetermined rotational frequency program until the at least two kinds of fluids are mixed in the chamber, wherein the predetermined rotational frequency program changes a direction of the rotation from one direction to the other direction before a vortex created in the chamber by the rotation of the one direction disappears.

2. The method of claim 1, wherein the at least two kinds of fluids are introduced sequentially into the chamber and the alternating rotation of the substrate is carried out after all of the at least two kinds of the fluids are introduced into the chamber.

3. The method of claim 1, wherein at least one of the at least two kinds of fluids is introduced into the chamber while the alternating rotation of the substrate is performed.

4. The method of claim 3, wherein a first fluid of the at least two kinds of fluids is introduced into a first chamber of the substrate; a second fluid of the at least two kinds of fluids is introduced into a second chamber which is placed in the substrate and is in fluid communication with the first chamber; and the second fluid flows into the first chamber and is mixed with the first fluid in the first chamber when the alternating rotation of the substrate is performed.

5. The method of claim 1, wherein a rotation frequency distribution of a clockwise rotation and a rotation frequency distribution of a counter-clockwise rotation is symmetrical or asymmetrical.

6. The method of claim 1, wherein a maximum rotation frequency of each of the clockwise and counter-clockwise rotations is in the range of 5 to 60 Hz.

7. The method of claim 6, wherein an initial rotation frequency of each of the clockwise and counter-clockwise rotations is in the range of more than 0 Hz and less than the maximum rotation frequency.

8. The method of claim 1, wherein each of the alternating rotation comprises an acceleration stage.

9. The method of claim 8, wherein the acceleration stage has a gradient in the range of 20 to 150 Hz/s.

10. The method of claim 1, wherein at least one of the at least two kinds of fluids comprises a plurality of particles having an average diameter up to 10 μm.

11. The method of claim 1, wherein the duration of each of the clockwise and counter-clockwise rotations is less than 10 seconds.

12. The method of claim 11, wherein the duration of each of the clockwise and counter-clockwise rotations is less than 1 second.

13. The method of claim 1, wherein the chamber comprises a protrusion on an inside surface of the chamber.

14. The method of claim 13, wherein the protrusion has a regular or irregular shape.

15. The method of claim 13, wherein the protrusion is a pattern engraved on an inside surface of the chamber.

* * * * *